US005090227A

United States Patent [19]

Takeda et al.

[11] Patent Number: 5,090,227

[45] Date of Patent: Feb. 25, 1992

[54] ROLL FORMING APPARATUS

[75] Inventors: Shin Takeda, Nagoya; Masami Ishii, Toyota; Mitsuhiro Ozawa, Hekinan; Toshihisa Terazawa, Ichinomiya, all of Japan

[73] Assignee: Aisin Seiki Kabushiki Kaisha, Kariya, Japan

[21] Appl. No.: 562,625

[22] Filed: Aug. 3, 1990

[30] Foreign Application Priority Data

Aug. 4, 1989 [JP] Japan ..... 1-203646

[51] Int. Cl.[5] ..... B21D 5/14

[52] U.S. Cl. ..... 72/178; 72/224

[58] Field of Search ..... 72/178, 181, 182, 176, 72/224–226

[56] References Cited

U.S. PATENT DOCUMENTS

| | | | |
|---|---|---|---|
| 606,306 | 6/1898 | Shann | 72/224 |
| 709,753 | 9/1902 | Ditchfield | 72/178 |
| 1,366,331 | 1/1921 | Palmer | 72/178 |
| 1,673,787 | 6/1928 | Frahm | 72/178 |
| 2,764,214 | 9/1956 | Reynolds | 72/176 |
| 2,843,178 | 7/1958 | Nighthart | 72/178 |
| 3,258,950 | 7/1966 | Durr | 72/176 |

*Primary Examiner*—Daniel C. Crane

*Attorney, Agent, or Firm*—Banner, Birch, McKie & Beckett

[57] ABSTRACT

A roll forming apparatus comprises a plurality of driving roll stands and a plurality of drivingless roll stands, wherein the drivingless roll forming stand comprises an upper and a lower roll units and side roll units arranged around a central through-hole of a plate member supported by a supporting post. Each of the roll forming stands is adapted for automatically positioning each of the rolls associated therewith to preset positions for bending operation. The plate member is rotatable about the axis of the central hole, and a transverse slide table fixedly mounting the supporting post is transversely movable to the axis. Molding laces for cars are roll formed by bending a strip during travelling through a series of these adjusted roll stands.

22 Claims, 4 Drawing Sheets

ROLL FORMING APPARATUS

FIELD OF THE INVENTION

The present invention relates to a roll forming apparatus for metal molding laces which may be utilized for roll forming of molding laces for automobiles, illumination covers for electrical appliances and various moldings or laces for construction materials.

BACKGROUND OF THE INVENTION

The JP Patent Kokai Publication 61-269936 (1986) discloses a prior art technology having pertinence to the present invention.

Referring to FIG. 9 to 11 showing a main body 1 of a conventional roll forming apparatus for metal molding laces, a plurality of rotationally driving roll stands 3, 4, . . . and a plurality of drivingless (or driven) small roll stands 2*a*, 2*b*, 2*c*, . . . are arrayed and drivingless small rolls 8, 9 are retained on an inclined surface and adapted to be moved vertically along double arrows. An arcuate (semi-circular) surface 6 is provided on a supporting post of a roll forming stand 2*a* and, which arcuate surface serves as an angle adjustment guide, the roll forming angle of the drivingless small rolls is adjustable by rotation along the direction of an arcuate arrow 6*a*. This adjustment is usually carried out by manual operation.

Problems to be Solved by the Invention

However, with the above described roll forming apparatus 1, the drivingless small roll forming stand 2*a* is adapted to form a starting molding lace material (i.e., metal strip) 7 by two rolls, that is an upper roll 8 and a lower roll 9, as shown in FIG. 7. The molding lace having substantially a rectangular cross-section as shown in FIG. 7 cannot be formed easily and can be formed only through the use of several forming stages. When the exchange is made from a lace of one shape and size to another, exchange of a plurality of small roll stages (drivingless small roll stands 2*a*, 2*b*, 2*c* . . . ) needs to be performed. This means a hindrance against improvement of the productivity for manufacturing diverse kinds of molding laces on one production line.

SUMMARY OF THE DISCLOSURE

It is an object of the present invention to provide a roll forming apparatus by means of which metal molding laces having any desired cross-section, particularly substantially the rectangular cross-section, may be formed easily.

It is another object of the present invention to provide a roll forming apparatus in which roll forming to a desired shape and size may be achieved by using one kind of the roll forming stand.

Other objects will become apparent from the overall disclosure.

Generally, a roll forming apparatus comprises a plurality of driving roll stands (or at least driving means for travelling a strip) and a plurality of roll forming stands which have usually drivingless forming rolls.

In accordance with the present invention there is provided a roll forming stand of a roll forming apparatus for a strip comprising:

(a) a transverse slide table which is movable and positionable transverse to an axis of the strip, (b) a rotatable plate member having a central through-hole and being rotatably secured on the slide table about an axis parallel to the axis of the strip, (c) an upper roll unit, a lower roll unit and side roll units which are disposed substantially around the central through-hole, and (d) shifting means associated with each of said roll units for positioning the rolls at predetermined positions relative to the axis of the strip.

Concretely, the roll forming stand comprises an upper roll unit, a lower roll unit and side roll units which are disposed, respectively and substantially, on the upper side, lower side and left-hand and right-hand sides of a central through-hole of the plate member supported by a supporting post. Each of side roll forming stands is adapted to automatically position each of the rolls associated with each of the roll forming stand to predetermined positions for bending operation. The plate member is rotatable about the axis of the central hole, and a transverse slide table fixedly mounting the supporting post is transversely movable to the axis of the central hole. Molding laces for cars etc. are roll formed by bending a strip during travelling through a series of these adjusted roll stands.

Particularly, a roll forming apparatus comprises a plurality of rotationally driving roll stands and a plurality of rotationally drivingless roll stands, wherein the drivingless roll forming stand comprises an upper roll unit, a lower roll unit and side roll units which are disposed, respectively, on the upper side, lower side and left-hand and right-hand sides of a central through-hole in a plate member supported by a supporting post, each of said roll forming stands is adapted to automatically position each of the rolls associated with each roll forming stand to predetermined positions by respective shifting means, said plate member is rotatable by the operation of a controlling motor and wherein a transverse slide table fixedly mounting the supporting post is transversely movable by shifting means.

By the same token, an intermediate or 2nd and further driving roll stands (e.g., 2 and/or 5 on FIG. 9) may be constituted similarly to the drivingless roll forming stands as far as the roll positioning mechanism is concerned by additionally providing respective driving means for rolls (or at least one of a pair of rolls). Such driving stands would require in most cases only a pair of rolls for causing the strip (or semi-formed molding lace) to travel. A through passage for allowing the strip (or rolled molding lace) to travel may replace the central through-hole. This additional measure enables a complete automatic operation.

By the provision of a number of drivingless small roll stands, and a set of small rolls consisting of upper, lower and both side small roll units at predetermined positions on a plate member of each roll forming stand, a flat strip (starting strip) supplied thereto by means of the driving roll stand is sequentially bent (i.e., roll formed) so as to be formed into a molding lace of a desired shape.

The small rolls of a roll forming stand constituting each roll forming stand are positioned and indexed by the operation of the shifting devices (generally, positioning means) at sequentially slightly different positions for producing a molding lace of a rectangular cross-section with a minimum number of, for example, four small rolls (units).

Even when the cross-sectional shape of a molding lace to be produced is changed, the roll forming operation may be performed without the necessity of exchanging or altering the positions of the small rolls by the operation of the positioning means comprised mainly of stepping motors and by the rotation of the plate member of each roll forming stand.

The present invention offers the following effects. That is, (a) The rolls can be positioned automatically by the automatic operation with the aid of the CPU to reduce the stage setting time and to save man power.

(b) The stable forming operation may be achieved by using side rolls for roll forming and quality control of the molding lace material with respect to the bend, torsion or wrinkles of the molding lace material so that the molding conditions may be standarized with elimination of the operation by the worker's intuition.

(c) The number of roll forming stands may be reduced as compared to that of the conventional apparatus with reduction in the costs of the forming rolls.

(d) It is only necessary to provide the rolls to be in use in the respective stages and to provide a predetermined number of the bascially same roll forming stands for each stage. The arrangement of the operating line of the overall roll forming process of the apparatus may be simplified to cope with preparation for the production of a number of kinds of molding laces promptly.

DESCRIPTION OF THE PREFERRED EMBODIMENTS

Figure 2:
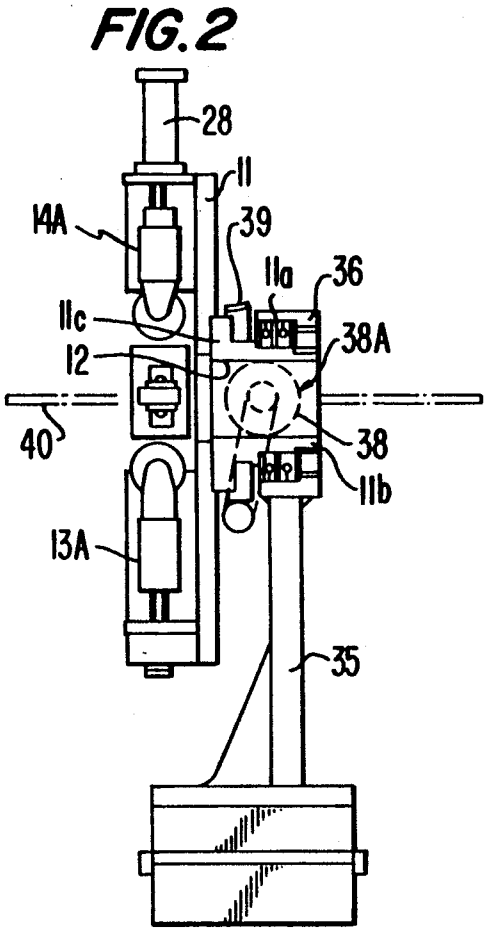
FIG. 2 is a side elevation viewed at a cross section along the direction A—A in FIG. 1.
Figure 1:
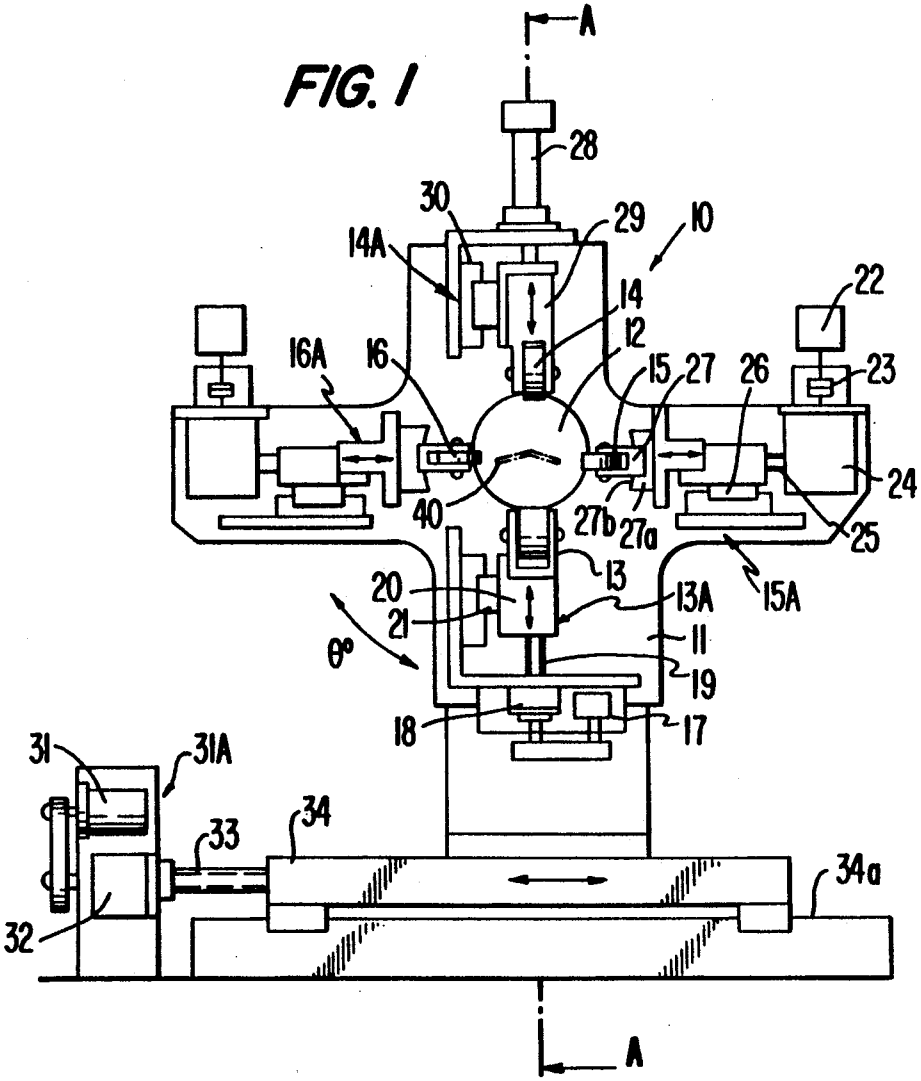
FIG. 1 is a front view showing an embodiment of the present invention.
Figure 3:
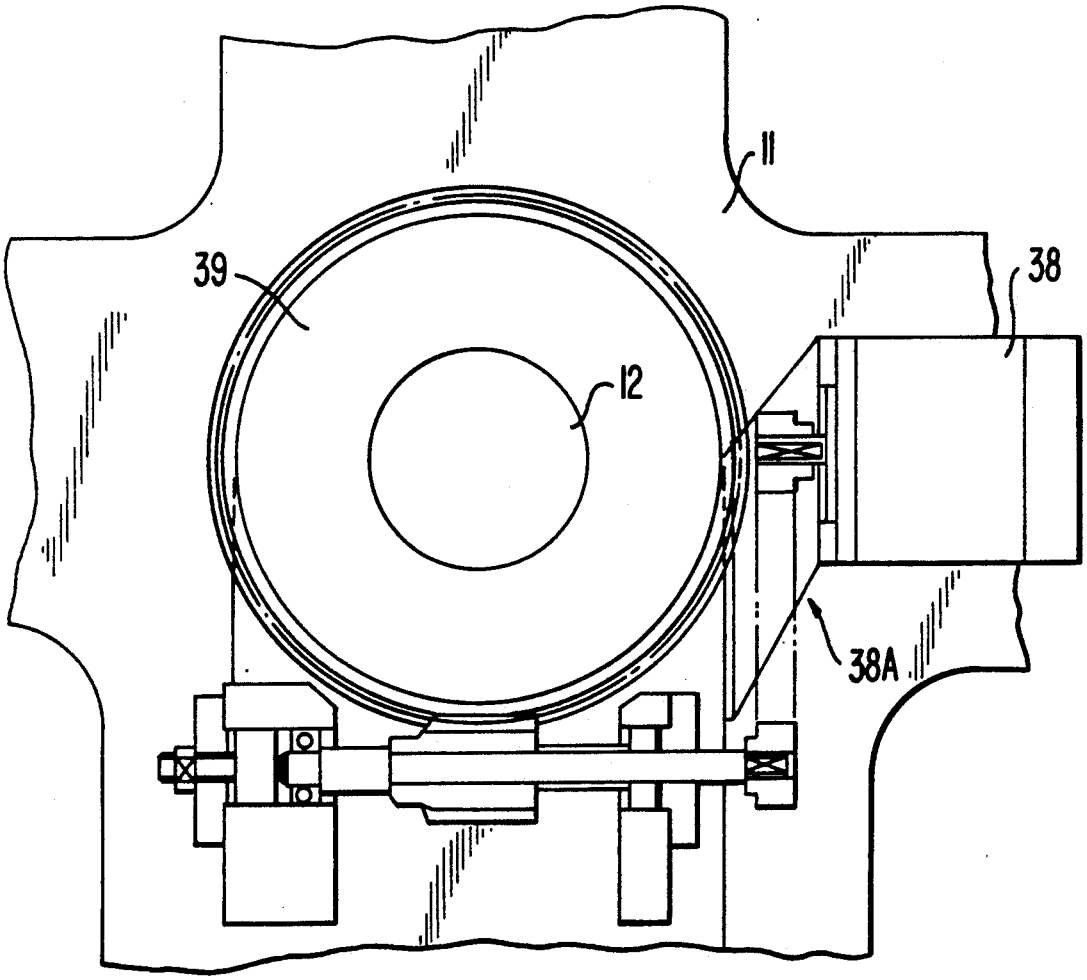
FIG. 3 is a rear side view showing essential portions of the embodiment shown in FIG. 1.

FIGS. 1 to 3 illustrate a roll forming stand (drivingless small roll forming stand) 10 of the present embodiment.

Figure 9:
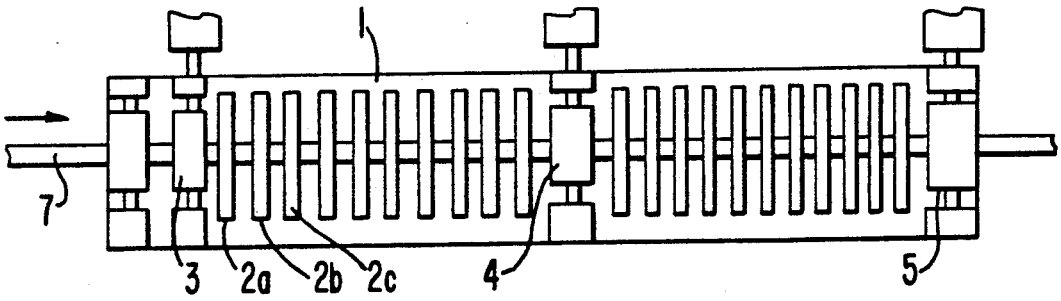
FIG. 9 PRIOR ART
FIG. 9 is a top plan view of a conventional roll forming apparatus.
Figure 10:
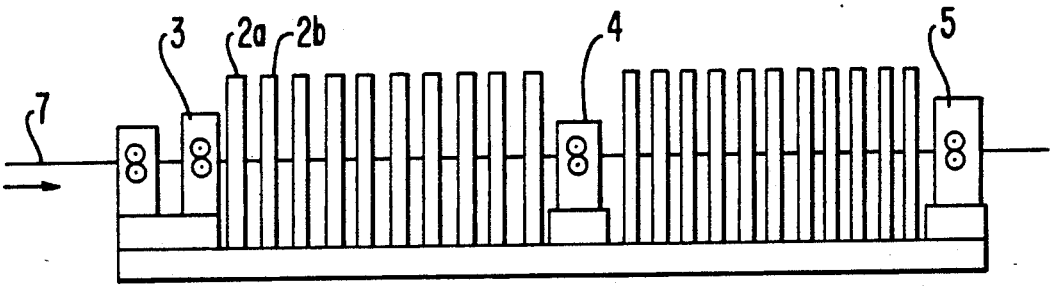
FIG. 10 PRIOR ART
FIG. 10 is a side elevational view thereof.
Figure 11:
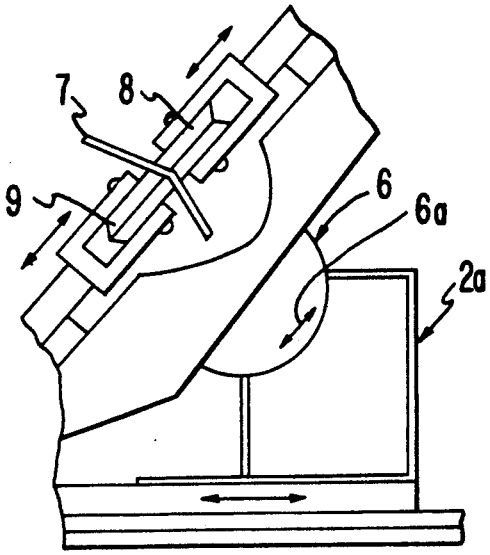
FIG. 11 PRIOR ART
FIG. 11 is a diagrammatic view showing a conventional roll forming stand employed in the roll forming apparatus of FIG. 9.

The roll forming stand 10 represents a series of roll forming stands which should replace the roll forming stands 2*a*, 2*b*, 2*c*, . . . of the roll forming apparatus 1 shown in FIGS. 9 and 10.

In the roll forming stand 10, the numeral 11 denotes a plate member secured via a bearing 11*a* to a cylindrical rotary member 11*b* and having a central through-hole 12. The plate member 11 is fixed to an end flange 11*c* formed on the cylindrical rotary member 11*b*.

The numeral 13A denotes a lower roll unit, the numeral 14A an upper roll unit and the numerals 15A and 16A denote side roll units arranged on both sides of the through-hole 12. These rolls units 13A, 14A, 15A and 16A are arranged on the upper, lower, left-hand and right-hand sides of the through-hole 12 and provided with upper, lower, left-hand and right-hand side rolls 13, 14, 15, 16, respectively, generally adapted as small rolls for bending and roll forming a flat metal strip into a metal lace 40 having a desired cross-sectional configuration.

The lower roll unit 13A includes a driving device (driving means) 17 comprised of a stepping motor, a locking mechanism 18, a ball screw rod mechanism 19, a roll holder 20 and a linear rail 21. The lower roll 13 may be moved vertically and indexed at a predetermined position by the motor operation of the stepping motor 17.

The side roll unit 15A includes a side roll 15 and a driving device comprising a stepping motor 22, a coupling 23, a worm wheel device 24, a ball screw rod mechanism 25, a linear rail 26 and a roll holder 27. The side roll unit 15A also includes a mechanism 27*b* for variably adjusting the rotational axis 15*a* of the side roll 15 within a predetermined angular extent with respect to the vertical. This angle adjustment mechanism 27*b* is composed of a slidable member adapted for sliding on a curved rail formed on the end face of a base 27*a*, and an associated driving device. The side roll 15 is adapted to be moved in the left and right directions by operation of the stepping motor 22. The side roll unit 16A is constructed similarly to the unit 15A and the side roll 16 is also driven similarly to the side roll 15.

The upper roll unit 14A is constituted by a hydraulic cylinder 28, a roll holder 29 and a linear rail 30 and the upper roll 14 may be moved vertically up- and downward by the operation of the hydraulic cylinder 28.

For causing the rotation through a predetermined angle $\theta°$ of the rolls 13, 14, 15 and 16, a worm wheel 39 is rotationally driven by a driving unit 38A comprised of a stepping motor 38, a belt and worm etc., as shown in FIG. 3, provided on a cylindrical member 36 secured to a supporting post 35, for causing rotation of the plate member 11 by means of the bearing 11*a* and the rotary member 11*b*.

The numeral 31A denotes a transverse slide apparatus adapted for shifting the plate member in the transverse (i.e., left and right) direction and including a driving unit 31, a locking mechanism 32, a ball screw rod 33 and a slide base 34 slidably disposed on the slide rail basement 34*a*.

A predetermined number of the above described roll stands are provided in accordance with the desired cross-sectional shape of the lace (2*a*, 2*b*, 2*c* etc. in FIG. 9).

The operation of the above described apparatus is hereinafter explained.

First of all, the first stage roll forming stand 2*a* is explained, which serves to roll form a bend B1 to provide a marginal rim of the strip.

Figure 4:
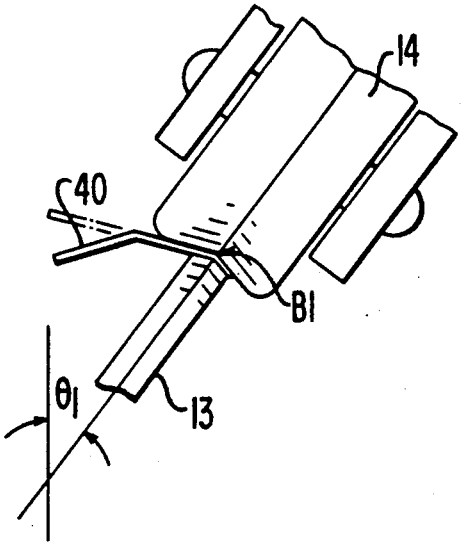
FIGS. 4 to 6 illustrate various bending (roll forming) steps of the present embodiment.

For shifting and positioning the upper, lower, left-hand and right-hand rolls at predetermined positions for forming a starting flat strip (generally flat, but may be preshaped one as shown in FIG. 4) into a first stage shape, the stepping motor 38 is actuated for rotating the plate member 11 through an angle $\theta_1$. This causes rotation of the upper, lower and side rolls to be rotated through an angle $\theta_1$ about the axis of the plate member which is the axis of the through-hole.

For setting the lower roll 13 as a reference, the lower roll 13 is fixedly indexed at the reference position by the operation of a stepping motor of the driving device 17.

In this case, the driving device 17 provided with the stepping motor is actuated for indexing the lower roll 13 at the reference position by the operation of the ball screw rod mechanism 19.

Then, by the preset program, the upper roll 14 is lowered by the operation of hydraulic cylinder 28 so as to be positioned for pressing and roll forming the metal strip. This completes the setting of the first stage roll stand 2*a*.

The setting of the second stage roll forming stand 2*b* is now performed, which serves to roll forming a bend B2. The plate member is rotated through an angle $\theta_2$, by the procedure similar to that for the above described first stage for presetting the lower roll 13 and the upper roll 14 at the predetermined positions as shown in FIG. 5.

Figure 5:
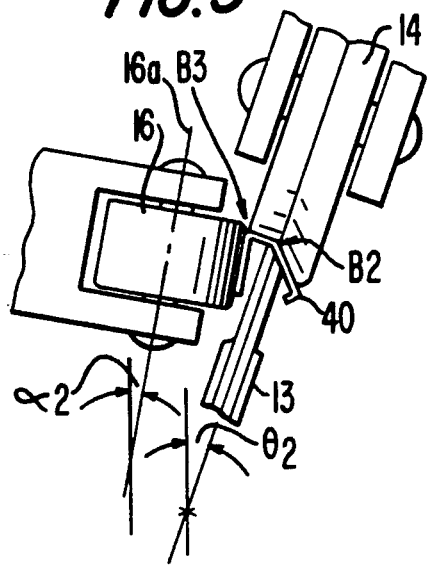

Then, in accordance with the preset program, the side roll 16 is moved towards right, at the same time that the rotational axis 16*a* of the side roll 16 is rotated through an angle $\alpha_2$ relative to the vertical to a position for bending the strip as shown in FIG. 5 such that two bends B2 and B3 are formed simultaneously. (Note, the bent B3 will be further shaped at the third stage.)

Figure 6:
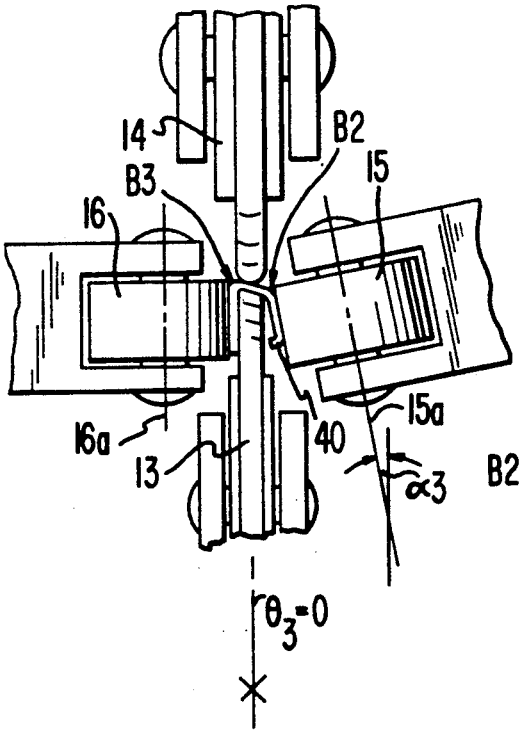
Figure 7:
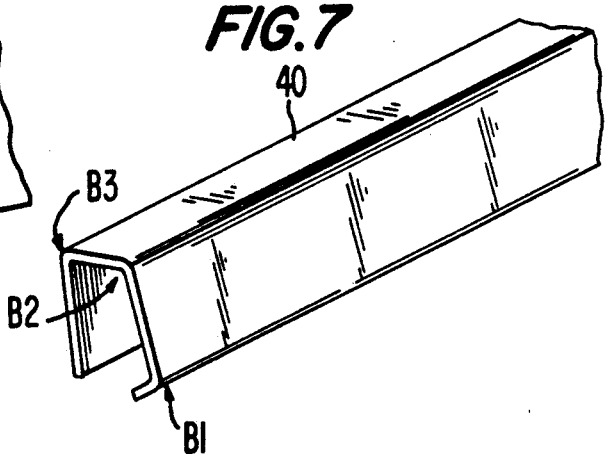
FIG. 7 is a perspective view showing a completed metal molding lace.
Figure 8:
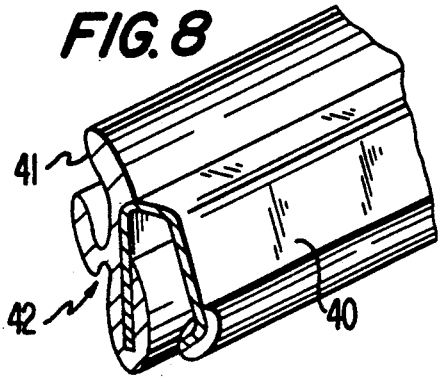
FIG. 8 is a perspective view showing a window molding lace obtained by molding rubber on the metal molding lace of FIG. 7.

The strip is further moved to a third stage roll stand serving as a final roll forming stage, in which the rolls 13 to 16 are set as that the right side roll 15 is moved towards left by the operation of the driving device to further press the sides of the strip for forming a shaped lace 40 having three bends B1 to B3 as shown in FIG. 7. That is, the upper and lower rolls 13, 14 are preset with the angle $\theta_3=0$, by the procedure similar to that used in the first stage so as to be positioned at the bend B3. The left side roll 16 is then set by the procedure similar to that used in the second stage. The right side roll 15 is then positioned to complete the setting for the third stage. At this time, the right roll 15 is set so that its rotational axis 15*a* is inclined at an angle of $\alpha 3$ with respect to the vertical as shown in FIG. 6 so as to leftwardly press the right side face of the lace extending between the bends B1 and B2. The left side roll 16, however, is set with its rotational axis 16*a* remaining in the vertical position.

In all the stages, the transverse adjustment should be done, although not stated at each stage, for alignment of the strip (or lace).

By arranging a plurality of stages of roll forming stands each having an upper roll, a lower roll and side rolls, and using suitably modified shapes of these rolls in the respective stages, the starting (flat) strip may be roll formed into a lace 40 having a rectangular cross-section defined by three bends B1 to B3, as an example as shown in FIG. 7.

Thus by arranging three stages of the roll forming stands and setting predetermined roll positions for the respective stages, the lace having the rectangular cross-section may be formed, with reduction in the setting time for the respective stages and reduction in the number of rolls and roll forming stands. The lace may be prevented from falling from the roll by setting the positions of the remaining rolls in the respective stages to idling positions for stable lace formation. Above all, since the respective rolls can be positioned with the aid of an electric control unit assisted by a CPU, and automatic factory manufacturing system (FMS) may be realized easily.

The rolls (small rolls) at each stage are disposed so as to be easily exchanged when necessary for manufacturing different shapes. But even without exchange of rolls an extensive adjustability of the roll arrangement to various shapes and sizes of the lace can be accomplished by the present invention.

It will be noted that a rubber molding lace 41 having a belt-like rim may be molded and affixed in situ to the rectangular lace 40 to produce a car window molding lace 42 e.g., by extrusion molding.

It should be noted that modifications in the art may be done without departing from the gist and scope of the present invention as herein disclosed and claimed.

What is claimed is:

1. A roll forming apparatus comprising a drivingless roll forming stand for roll forming a strip comprising:

(a) a transverse slide table which is movable and positionable transverse to a feed axis of the strip fed through the roll forming stand.

(b) a rotatable plate member having a central through-hole and being rotatably secured on the slide table about an axis parallel to the feed axis of the strip, (c) an upper roll unit, a lower roll unit and side roll units secured to said plate member all said roll units being nondriven said roll units disposed around the central through-hole, wherein said upper roll unit, said lower roll unit, and said side roll units rotate in unison about said through-hole as said plate member is rotated, and (d) shifting means associated with each of said rolls for independently positioning each rolls at predetermined positions relative to the plate member and the feed axis of the strip.

2. The roll forming apparatus as defined in claim 1, wherein said shifting means comprises means for shifting a roll pair of the upper roll and the lower roll and a roll pair of said side rolls along axes of movements defined for the respective roll pairs.

3. The roll forming apparatus as defined in claim 2, wherein said axes of movements intersect each other.

4. The roll forming apparatus as defined in claim 2, wherein said side roll pair further includes an angle adjustment means for adjusting the angles of the side rolls with respect to the axis of movement defined for the side roll pair.

5. The roll forming apparatus as defined in claim 2, wherein said axes of movements are within a plane parallel to the plane of the plate member.

6. The roll forming apparatus as defined in claim 4, wherein said angle adjustment means performs angle adjustment within a plane parallel to the plane of said plate member.

7. The roll forming apparatus as defined in claim 1, which comprises means for allowing exchange of the rolls of said roll forming stands.

8. The roll forming apparatus as defined in claim 1, wherein said shifting means for said roll units includes automatic control means.

9. The roll forming apparatus as defined in claim 4, wherein said angle adjustment means includes automatic control means.

10. The roll forming apparatus as defined in claim 1, wherein the rolls of said roll forming stand may be arranged to a roll forming position utilizing a combination of at least two of said rolls in the roll forming stand.

11. The roll forming apparatus as defined in claim 10, wherein said roll forming stand is constituted by the operation of a pair of the opposite rolls.

12. The roll forming apparatus as defined in claim 10, wherein said roll forming stand is constituted by the operation of two adjacent ones of said rolls.

13. The roll forming apparatus as defined in claim 10, wherein said roll forming stand is constituted by the operation of three adjacent ones of said rolls.

14. The roll forming apparatus as defined in claim 10, wherein said roll forming stand is constituted by the operation of all of said rolls.

15. A roll forming apparatus as defined in claim 1, which further includes at least one driving roll stand.

16. The roll forming apparatus as defined in claim 15, wherein said driving roll stand comprises:

(a) a transverse slide table which is movable and positionable transvere to a feed axis of the strip, (b) a rotatable plate member having a through-passage and being rotatably secured on the slide table about an axis parallel to the feed axis of the strip, (c) a pair of roll units opposed to each other and disposed substantially around the through-passage, at least one of the pair of roll units being a driving roll unit, (d) shifting means associated with each of said roll units for positioning the rolls at predetermined positions relative to the feed axis of the strip.

17. The roll forming apparatus as defined in claim 16, which further comprises additional pair of roll units disposed substantially around the through-passage on the plate member, and shifting means for positioning this additional pair of roll units.

18. The roll forming apparatus as defined in claim 1, wherein said upper roll unit, said lower roll unit and said side roll units are disposed substantially equiangularly around the central through-hole.

19. A roll forming apparatus comprising a plurality of driving roll stands and a plurality of drivingless roll stands, wherein the drivingless roll forming stand comprises an upper roll unit, a lower roll unit and side roll units which are disposed, respectively, on the upper side, lower side and left-hand and right-hand sides of a central through-hole of a plate member supported by a supporting post, all of the roll units of the drivingless roll stand being nondriven, each of said roll forming stands is adapted for automatically positioning each of the rolls associated with each of the roll forming stands to predetermined positions by respective shifting means, said shifting means for said drivingless roll forming stand independently shifting each of said upper roll unit, lower roll unit and side roll units relative to said plate member. and said plate member is rotatable by the operation of a controlling motor, said upper roll unit, said lower roll unit, and said side roll units rotate in unison about said through-hole as said plate member is rotated, and wherein a transverse slide table fixedly mounting the support post is transversely movable with respect to the axis of the central through-hole by shifting means.

20. The roll forming apparatus as defined in claim 19, wherein said plate member has a rotational axis parallel to the travelling direction of the strip.

21. The roll forming apparatus as defined in claim 19, wherein the supporting post for said plate member is movable transversely in a direction normal to a rotational axis of said plate member.

22. The roll forming apparatus as defined in claim 19, wherein said upper roll unit, said lower roll unit and said side roll units are disposed substantially equiangularly around the central through-hole.

* * * * *